US006926139B1

(12) United States Patent
Poole

(10) Patent No.: US 6,926,139 B1
(45) Date of Patent: Aug. 9, 2005

(54) COMPACT DISC AND PORTABLE PLAYER HOLDING DEVICE

(76) Inventor: Kayla A. Poole, 2418 Hickory Tree Rd., Balch Springs, TX (US) 75180

( * ) Notice: Subject to any disclaimer, the term of this patent is extended or adjusted under 35 U.S.C. 154(b) by 2 days.

(21) Appl. No.: 10/638,092

(22) Filed: Aug. 11, 2003

(51) Int. Cl.[7] ..... B65D 69/00
(52) U.S. Cl. ..... 206/232; 206/308.1
(58) Field of Search ..... D3/218, 289, 290, D3/632, 633, 634, 253; 206/308.1, 232, 311, 206/307, 307.1

(56) References Cited

U.S. PATENT DOCUMENTS

| | | | | | |
|---|---|---|---|---|---|
| 4,842,032 | A | | 6/1989 | Mastronardo | |
| 4,913,326 | A | * | 4/1990 | Echelson | 224/222 |
| 5,410,762 | A | | 5/1995 | Maskovich | |
| 5,651,485 | A | | 7/1997 | Impastato | |
| D382,995 | S | * | 9/1997 | Hale | D3/215 |
| D398,777 | S | * | 9/1998 | Epstein | D3/218 |
| 5,826,717 | A | | 10/1998 | Eskandry | |
| D404,908 | S | * | 2/1999 | Lollis | D3/215 |
| 6,006,915 | A | | 12/1999 | Moor | |
| D434,897 | S | * | 12/2000 | Hillman | D3/218 |
| D435,863 | S | * | 1/2001 | Eskandry | D19/27 |
| D436,443 | S | * | 1/2001 | Hillman | D3/283 |
| D455,260 | S | * | 4/2002 | Eskandry | D3/226 |
| D456,200 | S | * | 4/2002 | Eskandry | D6/631 |
| D460,260 | S | * | 7/2002 | Hassett | D3/299 |
| D472,372 | S | * | 4/2003 | Hassett | D3/218 |
| D472,706 | S | * | 4/2003 | Hassett | D3/289 |
| D486,031 | S | * | 2/2004 | Hillman | D6/633 |

* cited by examiner

*Primary Examiner*—Shian T. Luong

(57) ABSTRACT

A compact disc and portable player holding device includes a housing that includes an upper portion and a bottom portion. The upper portion includes an upper wall and a first peripheral wall that is attached to and extends downward from the upper wall. The bottom portion includes a bottom wall and second peripheral wall that is attached to and extends upwardly from the bottom wall. A pivot member is attached to the first peripheral wall and second peripheral wall for pivotally coupling the upper portion to the bottom portion. A securing assembly is attached to a free edge of the first and second peripheral walls for selectively securing together the free edges. Compact discs may selectively be positioned in the housing. A fastening assembly selectively fastens a compact disc player to the housing.

9 Claims, 4 Drawing Sheets

COMPACT DISC AND PORTABLE PLAYER HOLDING DEVICE

BACKGROUND OF THE INVENTION

1. Field of the Invention

The present invention relates to portable audio playing holding devices and more particularly pertains to a new portable audio playing holding device for holding a plurality of compact discs and a portable compact disc player.

2. Description of the Prior Art

The use of portable audio playing holding devices is known in the prior art. While these devices fulfill their respective, particular objectives and requirements, the need remains for a device that holds a portable compact disc player, a plurality of compact disc, a headset for coupling to the compact disc player and a plurality of articles.

SUMMARY OF THE INVENTION

The present invention meets the needs presented above by providing a housing having multiple pockets for compact discs and a fastening assembly for fastening a portable compact disc player to the housing.

Another object of the present invention is to provide a new portable audio playing holding device that includes a belt clip for attaching the housing of the device to a belt.

Still another object of the present invention is to provide a new portable audio playing holding device that includes a tether for securing a headset to the housing.

To this end, the present invention generally comprises a housing that includes an upper portion and a bottom portion. The upper portion includes an upper wall and a first peripheral wall that is attached to and extends downward from the upper wall. The bottom portion includes a bottom wall and second peripheral wall that is attached to and extends upwardly from the bottom wall. A pivot member is attached to the first peripheral wall and second peripheral wall for pivotally coupling the upper portion to the bottom portion. A securing assembly is attached to a free edge of the first and second peripheral walls for selectively securing together the free edges. Compact discs may selectively be positioned in the housing. A fastening assembly selectively fastens a compact disc player to the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
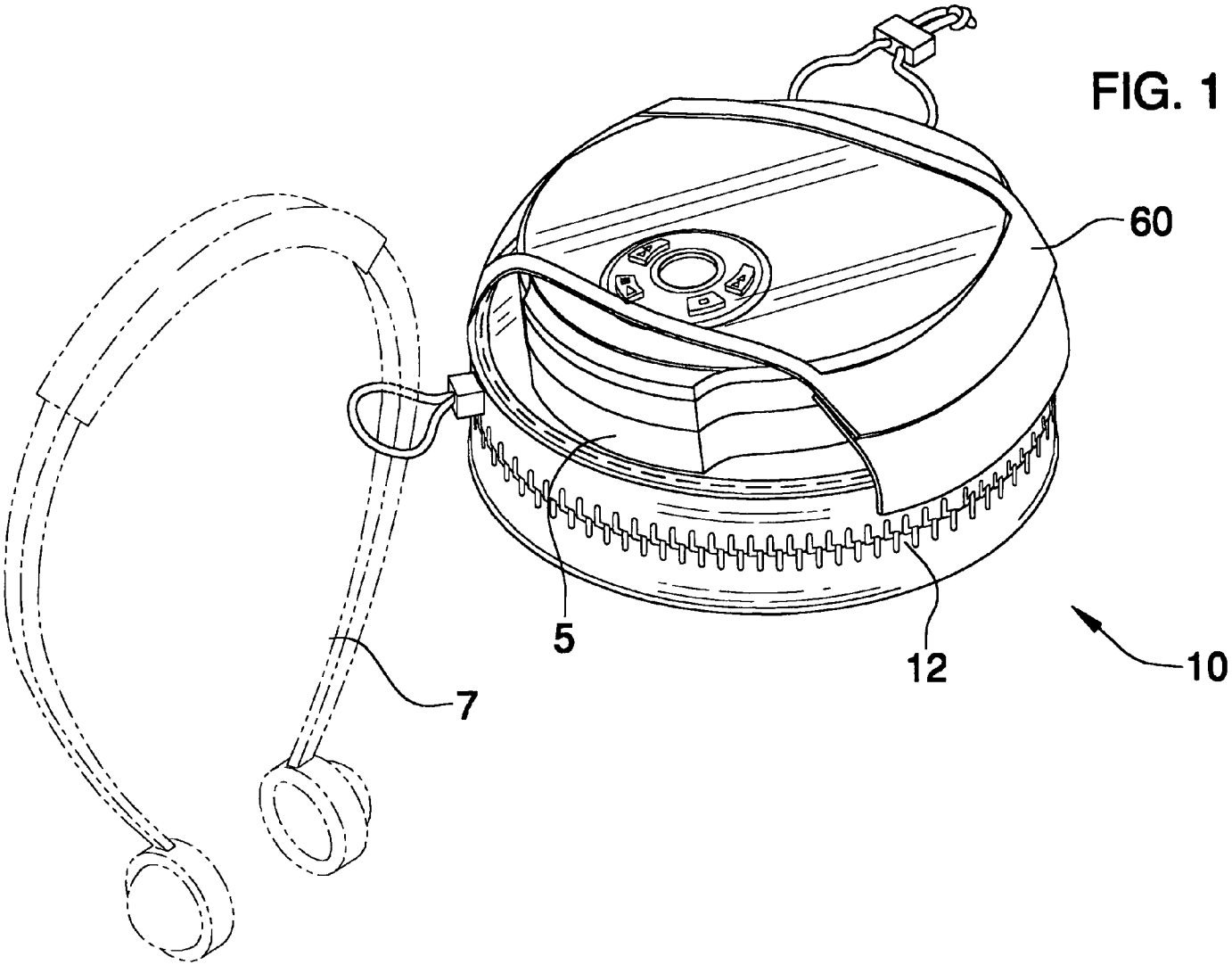
FIG. 1 is a schematic perspective view of a compact disc and portable player holding device according to the present invention.

With reference now to the drawings, and in particular to FIGS. 1 through 5 thereof, a new portable audio playing holding device embodying the principles and concepts of the present invention and generally designated by the reference numeral 10 will be described.

As best illustrated in FIGS. 1 through 5, the compact disc and portable player holding device 10 generally comprises a holder apparatus for selectively holding a plurality of compact discs 4 and a portable compact disc player 5. The apparatus comprises a housing 12 including an upper portion 14 and a bottom portion 18. The upper portion 14 includes an upper wall 15 and a first peripheral wall 16 that is attached to and extends downward from the upper wall 15. The bottom portion 18 includes a bottom wall 19 and second peripheral wall 20 that is attached to and extends upwardly from the bottom wall 19. A pivot member 22 is attached to the first peripheral wall 16 and second peripheral wall 20 for pivotally coupling the upper portion 14 to the bottom portion 18. The pivot member 22 is preferably comprised of a cloth material which is resiliently elastic. A securing assembly 24 is attached to a free edge 21 of the first 16 and second 20 peripheral walls for selectively securing together the free edges 21. The securing assembly 24 preferably comprises a zipper that extends along a length of the free edges 21. The upper 14 and bottom 18 walls each have a substantially circular shape. The upper wall 14 is preferably comprised of a transparent plastic material.

A first side pocket 28 is positioned in an interior of the upper portion 14. The first side pocket 28 is formed by a first interior wall 29 attached to the first peripheral wall 16 and is spaced from the upper wall 15. The first interior wall 29 wall extends across a portion of the upper wall 15. The first side pocket 28 has an opening 30 positioned opposite of the pivot member 22. A second side pocket 31 is positioned in an interior of the lower portion 18. The second side pocket 31 is formed by a second interior wall 32 attached to the second peripheral wall 20 and is spaced from the bottom wall 19. The first interior wall 32 extends across a portion of the bottom wall 19. The second side pocket 31 has an opening 33 positioned opposite of the pivot member 22. Conventional compact discs 4 may be selectively positioned in the first 28 and second 31 side pockets.

Figures 2, 3:
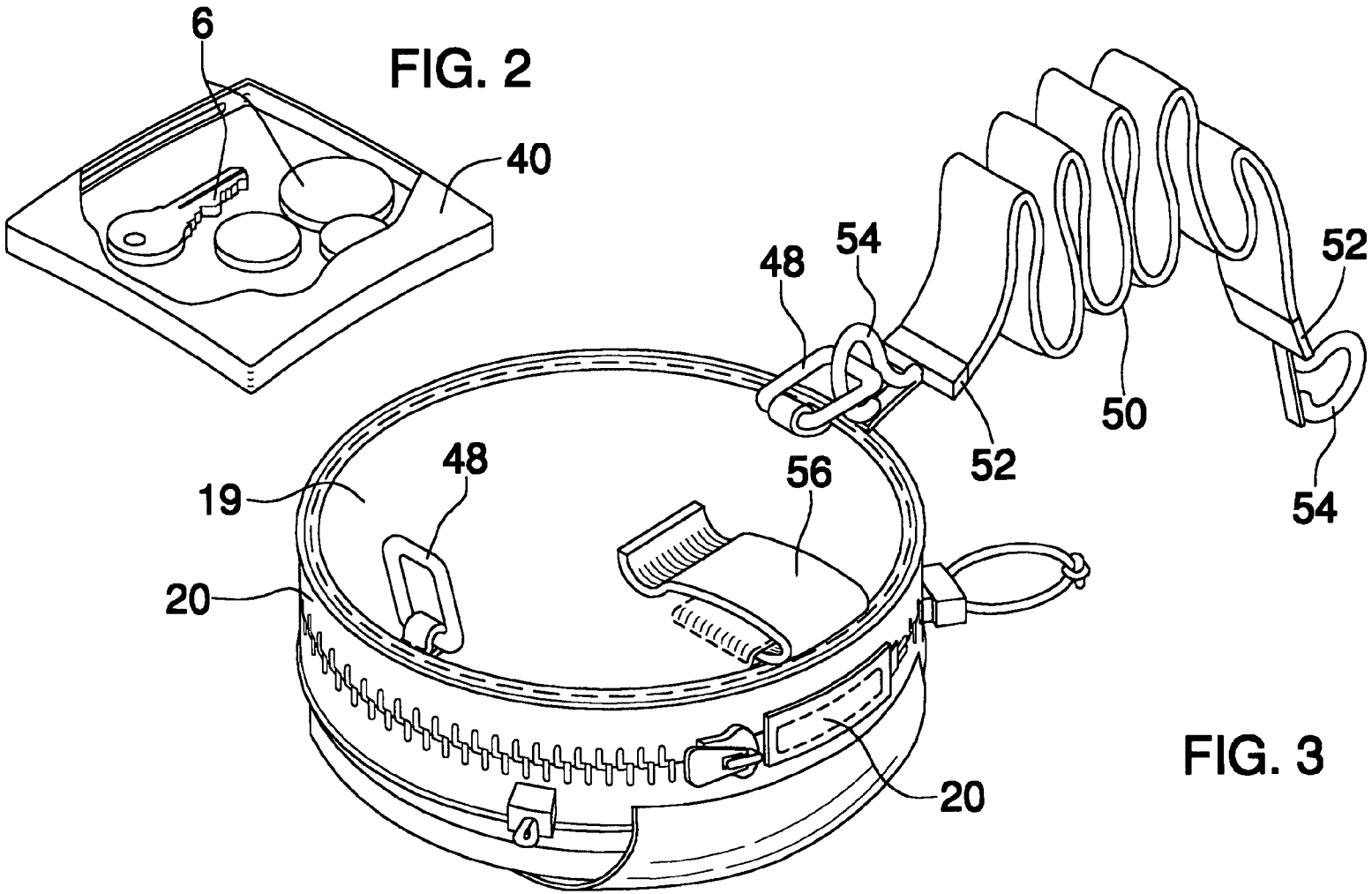
FIG. 2 is a schematic perspective view of the inner pocket of the present invention.
FIG. 3 is a schematic perspective view of the bottom of the housing of the present invention.
Figure 4:
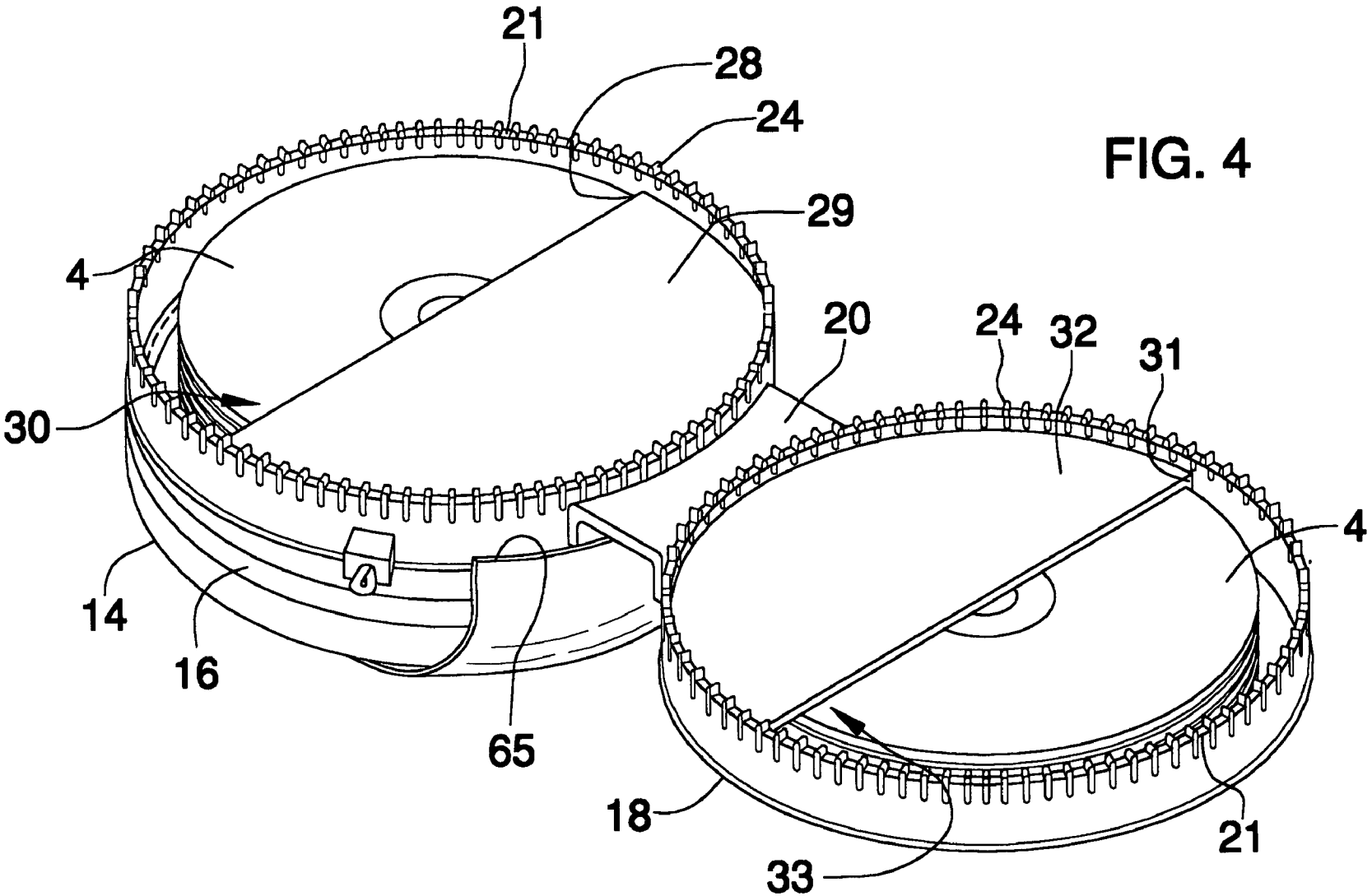
FIG. 4 is a schematic perspective view of the present invention with the housing in an open position.
Figure 5:
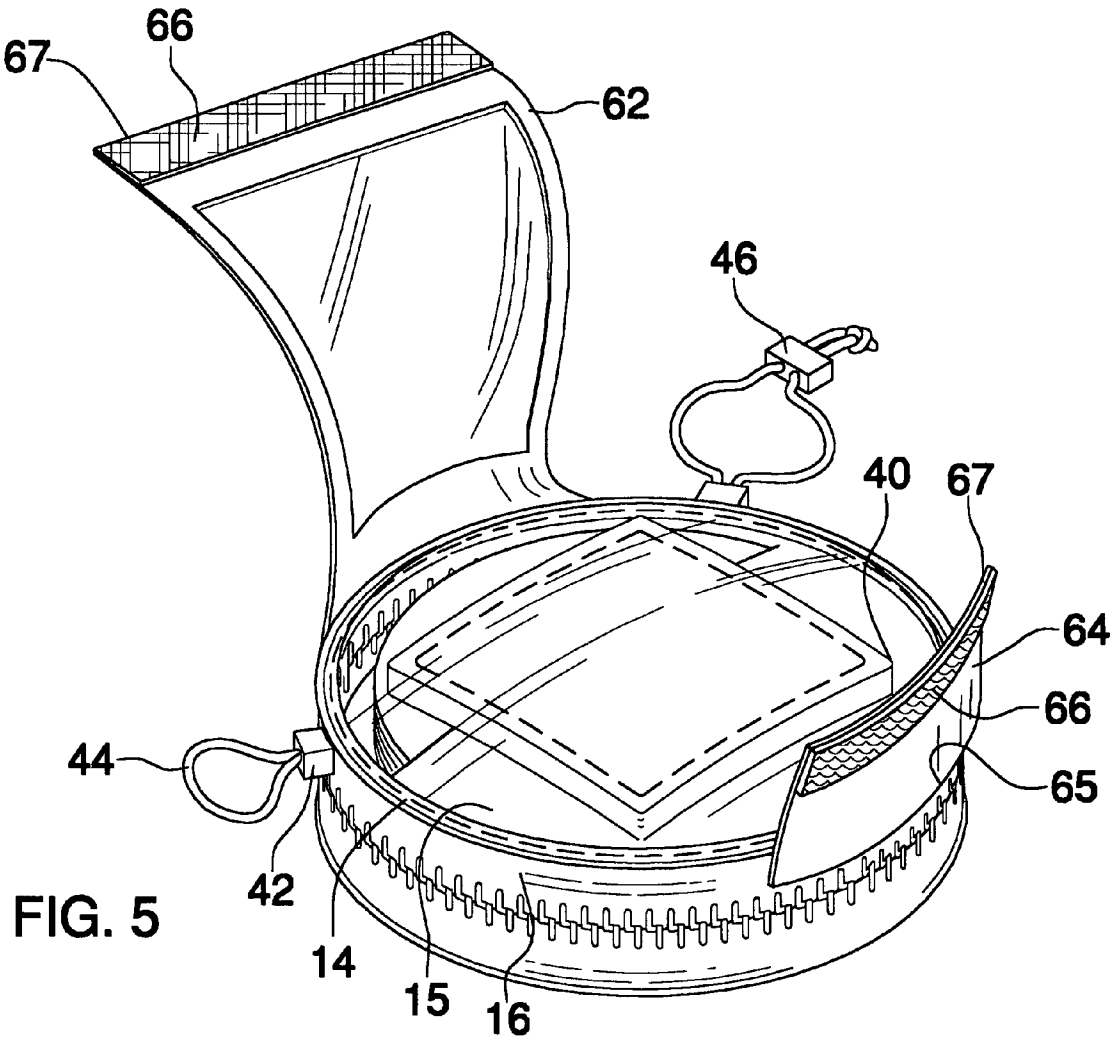
FIG. 5 is a schematic perspective view of the top of the housing of the present invention.

An inner pocket 40 is attached to an inner surface of the upper wall 15. The inner pocket 40 is designed for holding articles 6 such as keys, coins and other small objects. FIG. 2 is a broken illustration of the inner pocket 40 removed from the housing 12 very better viewing.

A tethering member 42 is attached to the upper portion for selectively tethering a headset 7 or headphones to the upper portion 14. The tethering member 42 includes a flexible loop 44 extending outwardly away from the upper portion 14. The loop 44 is preferably strung through the housing 12 and outward an opposite side of the housing 12 to create a free end 46. The free end 46 is pulled to tighten the loop 44 around a portion of a headset 7.

Each of a pair of ring members 48 is attached to the bottom portion 18. The rings members 48 are positioned generally opposite with respect to each other on the bottom portion 18. Each of the ring members 48 is positioned adjacent to a juncture of the bottom wall 19 and the second peripheral wall 20. An elongated flexible member 50 has a pair of ends 52. Each of a pair of clips 54 is attached to one of the pair of ends 52. Each of the clips 54 is selectively attachable to one of the ring members 48. The elongate member 50 may be used as a shoulder strap.

A belt clip 56 is attached to the bottom wall 19 and is positioned adjacent to the second peripheral wall 20. The belt clip 56 is a rigid member which can be placed in the belt or upper edge of pants of the user of the device 10.

A fastening assembly 60 selectively fastens the compact disc player 5 to the housing 12. The fastening assembly 60 includes a pair of flaps 62, 64. Each of the flaps 62, 64 has an attached end 65 attached to the upper portion 14. The attached ends 65 are positioned generally opposite to each other with respect to the top portion 14. A hook and loop securing combination 66 selectively secures free ends 67 of the pair of flaps 62, 64 to each other. A first of the flaps 62 is longer than a second of the flaps 64. The first of the flaps 62 has a substantially transparent window 67 positioned therein for selectively viewing the compact disc player 5 positioned between the flaps 62, 64 and the upper wall 15.

In use, the device 10 is used for holding a portable compact disc player 5 and a plurality of compact discs 4. In addition, the device 10 includes a tether 42 for holding the headset 7 of the compact disc player 5. Keys, credit cards, coins and other small articles 6 may be held in the inner pocket 40.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A holder apparatus for selectively holding a plurality of compact discs and a portable compact disc player, said apparatus comprising:

a housing including an upper portion and a bottom portion, said upper portion including an upper wall and a first peripheral wall being attached to and extending downward from said upper wall, said bottom portion including a bottom wall and a second peripheral wall being attached to and extending upwardly from said bottom wall, a pivot member being attached to said first peripheral wall and second peripheral wall for pivotally coupling said upper portion to said bottom portion, a securing assembly being attached to a free edge of said first and second peripheral walls for selectively securing together said free edges, wherein compact discs may selectively be positioned in said housing;

an inner pocket being attached to an inner surface of said upper wall;

a tethering member being attached to said upper portion for selectively tethering a headset to the upper portion, said tethering member including a flexible loop extending outwardly away from said upper portion; and a fastening assembly for selectively fastening a compact disc player to said housing, said fastening assembly including a pair of flaps, each of said flaps having an attached end attached to said upper portion, said attached ends being positioned generally opposite to each other with respect to said top portion, a hook and loop securing combination selectively secures free ends of said pair of flaps to each other, a first of said flaps being longer than a second of said flaps, said first of said flaps having a substantially transparent window positioned therein for selectively viewing a compact disc player positioned between the flaps and said upper wall.

2. The holder apparatus of claim 1, wherein said securing assembly comprises a zipper extending along a length of said free edges.

3. The holder apparatus of claim 1, further including a first side pocket being positioned in an interior of said upper portion, said first side pocket being formed by a first interior wall attached to said first peripheral wall and being spaced from said upper wall.

4. The holder apparatus of claim 3, further including a second side pocket being positioned in an interior of said lower portion, said second side pocket being formed by a second interior wall attached to said second peripheral wall and being spaced from said bottom wall, said second interior wall extending across a portion of said bottom wall.

5. The holder apparatus of claim 4, wherein said first and second side pockets each have an opening positioned opposite of said pivot member.

6. The holder apparatus of claim 1, further including a pair of ring members being attached to said bottom portion, said rings members being positioned generally opposite with respect to each other on said bottom portion.

7. The holder apparatus of claim 6, further including an elongated flexible member having a pair of ends, each of a pair of clips being attached to one of said pair of ends, each of said clips being selectively attachable to one of said ring members.

8. The holder apparatus of claim 1, further including a belt clip being attached to said bottom wall and being positioned adjacent to said second peripheral wall.

9. A holder apparatus for selectively holding a plurality of compact discs and a portable compact disc player, said apparatus comprising:

a housing including an upper portion and a bottom portion, said upper portion including an upper wall and a first peripheral wall being attached to and extending downward from said upper wall, said bottom portion including a bottom wall and second peripheral wall being attached to and extending upwardly from said bottom wall, a pivot member being attached to said first peripheral wall and a second peripheral wall for pivotally coupling said upper portion to said bottom portion, a securing assembly being attached to a free edge of said first and second peripheral walls for selectively securing together said free edges, said securing assembly comprising a zipper extending along a length of said free edges, said upper and bottom walls each having a substantially circular shape;

a first side pocket being positioned in an interior of said upper portion, said first side pocket being formed by a first interior wall attached to said first peripheral wall and being spaced from said upper wall, said first interior wall extending across a portion of said upper wall, said first side pocket having an opening positioned opposite of said pivot member;

a second side pocket being positioned in an interior of said lower portion, said second side pocket being formed by a second interior wall attached to said second peripheral wall and being spaced from said bottom wall, said second side pocket having an opening positioned opposite of said pivot member, wherein compact discs may be selectively positioned in said first and second side pockets;

an inner pocket being attached to an inner surface of said upper wall;

a tethering member being attached to said upper portion for selectively tethering a headset to the upper portion, said tethering member including a flexible loop extending outwardly away from said upper portion;

a pair of ring members being attached to said bottom portion, said rings members being positioned generally opposite with respect to each other on said bottom portion, each of said ring members being positioned adjacent to a juncture of said bottom wall and said second peripheral wall;

an elongated flexible member having a pair of ends, each of a pair of clips being attached to one of said pair of ends, each of said clips being selectively attachable to one of said ring members;

a belt clip being attached to said bottom wall and being positioned adjacent to said second peripheral wall; and a fastening assembly for selectively fastening a compact disc player to said housing, said fastening assembly including a pair of flaps, each of said flaps having an attached end attached to said upper portion, said attached ends being positioned generally opposite to each other with respect to said top portion, a hook and loop securing combination selectively secures free ends of said pair of flaps to each other, a first of said flaps being longer than a second of said flaps, said first of said flaps having a substantially transparent window positioned therein for selectively viewing a compact disc player positioned between the flaps and said upper wall.

* * * * *